US009505207B2

(12) United States Patent
Whitelaw et al.

(10) Patent No.: US 9,505,207 B2
(45) Date of Patent: Nov. 29, 2016

(54) COLOUR PROOFING APPARATUS AND METHOD

(75) Inventors: Gordon Whitelaw, Bigola (AU); Wolfgang Brusdeilins, Bielefeld (DE)

(73) Assignee: Bobst Bielefeld GmbH, Bielefeld (DE)

( * ) Notice: Subject to any disclaimer, the term of this patent is extended or adjusted under 35 U.S.C. 154(b) by 115 days.

(21) Appl. No.: 14/000,571

(22) PCT Filed: Feb. 9, 2012

(86) PCT No.: PCT/EP2012/052168

§ 371 (c)(1),
(2), (4) Date: Oct. 23, 2013

(87) PCT Pub. No.: WO2012/113649

PCT Pub. Date: Aug. 30, 2012

(65) Prior Publication Data

US 2014/0033938 A1 Feb. 6, 2014

(30) Foreign Application Priority Data

Feb. 25, 2011 (EP) ..... 11155963

(51) Int. Cl.

| | |
|---|---|
| ***B41F 1/34*** | (2006.01) |
| ***B41F 33/00*** | (2006.01) |
| ***B41F 5/20*** | (2006.01) |
| ***B41F 9/04*** | (2006.01) |

(52) U.S. Cl.

CPC ..... *B41F 33/0036* (2013.01); *B41F 5/20* (2013.01); *B41F 9/04* (2013.01); *B41P 2200/12* (2013.01)

(58) Field of Classification Search

CPC ..... B41F 5/20; B41F 33/0036; B41F 31/02; B41F 31/022; B41F 31/027; B41F 31/04; B41F 31/12

See application file for complete search history.

(56) References Cited

U.S. PATENT DOCUMENTS

| | | | | |
|---|---|---|---|---|
| 3,703,863 | A * | 11/1972 | Giuiuzza | 101/183 |
| 4,098,184 | A * | 7/1978 | Okada et al. | 101/41 |
| 4,720,888 | A * | 1/1988 | Menz | 15/246 |
| 4,852,486 | A * | 8/1989 | Ely et al. | 101/218 |
| 5,226,364 | A * | 7/1993 | Fadner | 101/366 |
| 5,546,858 | A * | 8/1996 | Stephan | 101/142 |
| 6,024,018 | A * | 2/2000 | Darel et al. | 101/365 |
| 6,333,987 | B1 * | 12/2001 | Reinhard et al. | 382/112 |
| 6,422,143 | B1 | 7/2002 | Lawrence et al. | |
| 7,281,473 | B2 * | 10/2007 | Westby et al. | 101/218 |
| 8,240,250 | B2 * | 8/2012 | Boettcher | B41F 9/1036 101/350.1 |
| 2002/0134130 | A1 * | 9/2002 | Johnson | 73/1.01 |
| 2003/0067502 | A1 * | 4/2003 | Arquilevich et al. | 347/19 |
| 2004/0173113 | A1 * | 9/2004 | Dunninger et al. | 101/408 |
| 2006/0260491 | A1 * | 11/2006 | Westby | 101/480 |

(Continued)

FOREIGN PATENT DOCUMENTS

| | | | |
|---|---|---|---|
| DE | 19924614 | A1 | 11/2000 |
| GB | 2204396 | A | 11/1988 |

*Primary Examiner* — David Banh

(74) *Attorney, Agent, or Firm* — Richard M. Goldberg

(57) ABSTRACT

A color proofing apparatus, including an engraved roller (12) having a pattern of ink accommodating cavities on its peripheral surface, a back pressure cylinder (14) forming a nip with the engraved roller (12), a conveyor (16) adapted to feed a sheet (18) of a print substrate through the nip in synchronism with the movements of the peripheral surfaces of the engraved roller (12) and the back pressure cylinder (14), and an optical sensor (30) disposed at the conveyor (16) for measuring a color value of the sheet (18) that has passed through the nip.

14 Claims, 2 Drawing Sheets

(56) References Cited

U.S. PATENT DOCUMENTS

2007/0119317 A1* 5/2007 Takagi ..... 101/227
2007/0125246 A1* 6/2007 Dawley et al. ..... 101/147
2007/0139703 A1* 6/2007 Shimamura et al. ..... 358/1.15
2007/0169651 A1* 7/2007 Michels ..... B41F 31/022 101/350.5
2007/0177175 A1* 8/2007 Matsuoka ..... 358/1.9
2007/0227389 A1* 10/2007 Huber et al. ..... 101/484
2007/0266874 A1* 11/2007 Karla et al. ..... 101/480
2008/0252948 A1* 10/2008 Onishi ..... 358/504
2010/0005985 A1* 1/2010 Westby ..... 101/218
2012/0070040 A1* 3/2012 Vans et al. ..... 382/112
2013/0003063 A1* 1/2013 Headley et al. ..... 356/402
2013/0016208 A1* 1/2013 Duss et al. ..... 348/92
2013/0113859 A1* 5/2013 Suzuki ..... 347/19

* cited by examiner

COLOUR PROOFING APPARATUS AND METHOD

BACKGROUND OF THE INVENTION

The invention relates to a colour proofing apparatus and to a method of colour proofing and flexographic printing.

In the printing industry, it is desired to be able to predict a colour value of a printed product or a certain area of the printed product before a print run is started, so that colour errors may be detected and eliminated, e.g. by adjusting the settings of the printing press, changing the recipe of the inks and/or, in the case of flexographic printing, selecting an engraved roller with a different screen.

It has been known to use a hand-held proofing apparatus having an inking roller for applying an ink film onto a sample of the substrate and then to inspect the colour of the ink film on the substrate.

Other known proofing methods attempt to simulate the entire flexographic print process by using a colour proofing apparatus that is configured as a miniature version of the printing press.

SUMMARY OF THE INVENTION

It is an object of the invention to improve the accuracy with which the colour of a printed product to be obtained in a print process, in particular a flexographic print process, can be predicted.

To that end, the invention proposes a colour proofing apparatus comprising:

- an engraved roller having a pattern of ink accommodating cavities on its peripheral surface,
- a back pressure cylinder forming a nip with the engraved roller,
- a conveyor adapted to feed a sheet of a print substrate through said nip in synchronism with the movements of the peripheral surfaces of the engraved roller and the back pressure cylinder, and
- an optical sensor disposed at the conveyor for measuring a colour value of the sheet that has passed through the nip.

This colour proofing apparatus assures not only a high reproducibility in the generation of the proof but also a high reproducibility in the measurement of the colour value, because the optical sensor is integrated in the proofing apparatus and disposed at the conveyor, so that the colour measurement will always be performed under equal or at least comparable conditions.

The method of colour proofing and flexographic printing according to the invention uses the colour proofing apparatus described above and comprises the steps of:

- inking the engraved roller with a sample of an ink to be used for printing,
- passing a sheet of a print substrate of the type to be used for printing through the nip formed between the engraved roller and the back pressure cylinder, thereby to print an ink layer onto the sheet,
- measuring a colour value of the ink layer and
- using the measured colour value for predicting a colour of a print product obtained in a flexographic print process in which said ink is applied to an anilox roller having a screen corresponding to that of the engraved roller in the proofing apparatus, and the ink is then transferred onto a printing cylinder from which it is transferred onto said print substrate.

Thus, according to the invention, the proofing method simulates a rotogravure print process rather than the actual flexographic print process. This has the advantage that the reproducibility of the proofing step is improved significantly, because variations of a number of parameters and conditions that would otherwise affect the colour of the proof can be reduced or eliminated. In a flexographic print process, the colour of the printed product is affected among others by the pressure with which the engraved roller is set against the printing cylinder, and the pressure with which the printing cylinder is pressed against the print substrate and the back pressure cylinder. In the proofing step according to the invention, these two variables are replaced by a single parameter, i.e. the pressure with which the engraved roller is set against the print substrate and the back pressure cylinder. Moreover, since the proofing process is much slower than the actual flexographic print process in a rotary printing press, the colour of the proof is largely affected by the length of the time period in which the ink is allowed to dry before it is deposited on the print substrate. It is therefore a remarkable advantage that the ink is transferred directly from the engraved roller to the print substrate, which eliminates the effect of dry time of the ink on the peripheral surface of a printing cylinder.

On the other hand, in comparison to proofing with hand-held devices, the invention has the advantage that variables such as the pressure with which the engraved roller is pressed against the print substrate are determined by the configuration and setting of the proofing apparatus and are therefore more reproducible than the results obtained with a hand-held device.

Of course, the measured colour value that is obtained with the method described above cannot reflect the effects of the printing cylinder in an actual flexographic print process. These effects may however be determined empirically and/or may be described by a mathematical model, so that, when the measured colour value of the ink layer on the proof is entered into this model, it is possible to predict the colour value that will be obtained on the actual print product.

By employing a highly reproducible procedure for obtaining a proof and measuring the colour thereof and then using the measured colour value for predicting the colour of the printed product, the prediction accuracy can be improved remarkably.

More specific optional features of the invention are indicated in the dependent claims.

In the method according to the invention, a number of different engraved roller screens may be used for printing a plurality of ink layers onto the substrate, so that measured colour values are obtained for different engraved roller screens. Then, the engraved roller screen which provides the best results may be selected for the print process.

On the basis of a plurality of colour values obtained for different screens, it is also possible to interpolate colour values for screens that have not actually been tested.

The colour proofing apparatus according to the invention may comprise an engraved roller which has a plurality of different screens on its peripheral surface. Preferably, the screens are arranged in bands that extend in longitudinal direction of the engraved roller, so that a large number of ink layers, each obtained with a different screen, are printed onto the substrate during a complete rotation of the engraved roller. Since these ink layers will move past the optical sensor when the sheet is moved-on with the conveyor, it is possible to use an optical sensor that is mounted stationarily in the proofing apparatus and is capable of measuring the colour values of the various ink layers one after the other.

This will not only simplify the construction of the apparatus but will also assure that the colour measurement is performed always under the same illumination conditions. Preferably, an illumination system is also mounted stationarily in the apparatus, and the colour sensor and the illumination system are shielded from external light.

In a preferred embodiment, the colour proofing apparatus is accommodated in an air-tight casing in which an elevated air pressure may be maintained while the ink layer is formed on the sheet. The increased air pressure will delay the drying of the ink on the surface of the engraved roller and may thus at least partly compensate the effect that the dwell time of the ink on the surface of the engraved roller in the proofing apparatus is larger than the dwell time of the ink on the surface of the anilox roller (and the printing cylinder) in a high-speed printing press.

The back pressure cylinder of the proofing apparatus may have a rubber-elastic surface layer and may be arranged to be set against the engraved roller with a predetermined force, so that the line pressure in the nip between the back pressure cylinder and the engraved roller will always be the same, regardless of the thickness of the print substrate. As an alternative, the back pressure cylinder may be locked in a fixed position relative to the engraved roller.

In order to avoid differential peripheral speeds of the engraved roller and the back pressure cylinder, which could result in a change of the colour value due to slippage between the engraved roller and the print substrate, it is preferable that the back pressure cylinder is driven with a peripheral speed that is similar but not identical to that of the engraved roller, and a one-way clutch is provided in the drive train of the back pressure cylinder, so that the speed of the back pressure cylinder may readily adjust to that of the engraved roller when a sheet of the print substrate passes through. To that end, the back pressure cylinder should also have a moment of inertia as small as possible. For example, the back pressure cylinder may be formed of fibre-reinforced carbon.

The proofing apparatus may further include a cutting system arranged to cut or punch a print substrate sheet with predetermined size from a blank. This is not only convenient for the operator but also assures that the print substrate sheets will always have the same size, especially in axial direction of the engraved roller, so that the line pressure in the nip will always be the same.

In a preferred embodiment, the conveyor for conveying the sheets through the nip is formed by two parallel conveyor belts which support the opposite lateral edges of the sheet while the central part of the sheet is passed through between the engraved roller and the back pressure cylinder. At least a part of the cutting dies for punching out the sheet may be fixed on the conveyor belts and may be configured as holders for holding the sheet while it is fed through the proofing apparatus. Thus, once the sheet has been punched out, e.g. manually, the rest of the proofing process, including the measurement of the colour values, may be performed automatically without further intervention of an operator.

The process may be controlled such that the back pressure cylinder is set against the engraved roller only after the leading edge of the sheet has passed through and is withdrawn again from the engraved roller before the trailing edge of the sheet passes through. Thus, the back pressure cylinder will come into contact only with the print substrate sheet but not with the ink-carrying peripheral surface of the engraved roller. This avoids the necessity to clean the back pressure cylinder after each proofing process.

The only member of the proofing apparatus that needs to be cleaned after each proofing operation will be the engraved roller. To that end, the back pressure cylinder and a cleaning unit may be mounted on a common carriage that, when a proofing process has been completed, is moved into a position where the surface of the engraved roller can automatically be cleaned with the cleaning device.

BRIEF DESCRIPTION OF THE DRAWINGS

An embodiment example will now be described in conjunction with the drawings, wherein.

DETAILED DESCRIPTION

Figure 1:
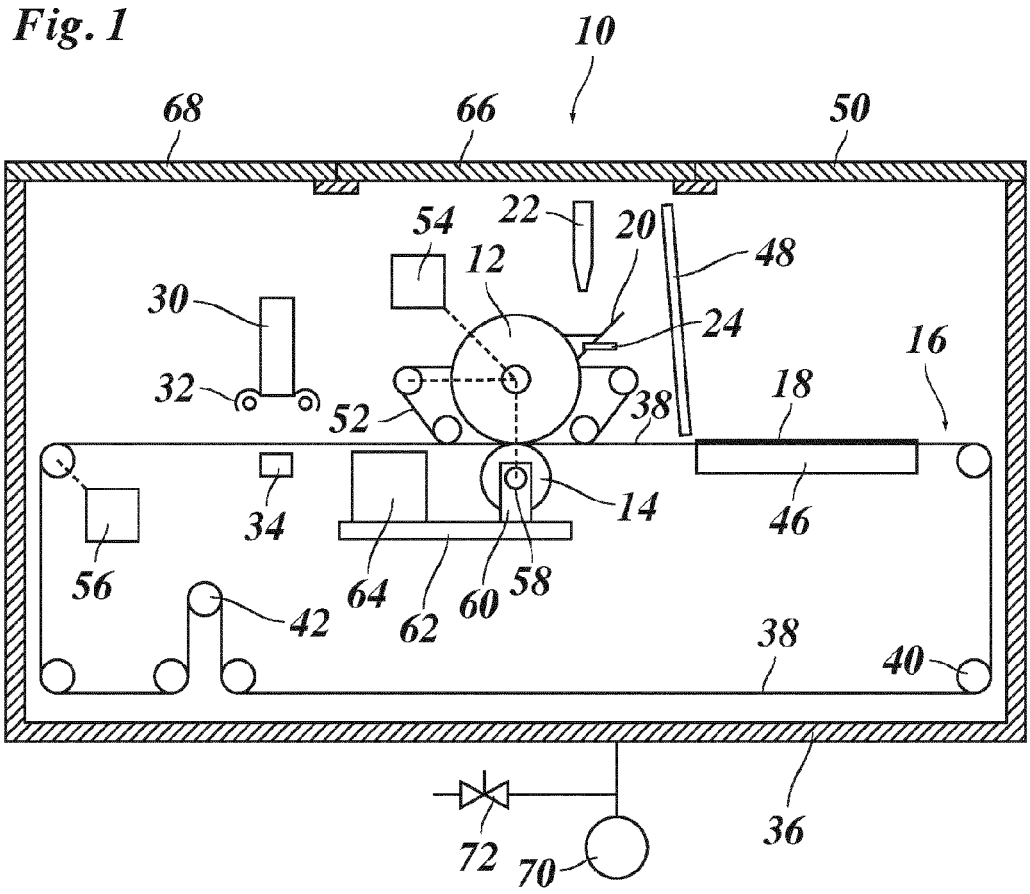
FIG. 1 is a schematic cross-sectional view of a colour proofing apparatus according to the invention.

As is shown in FIG. 1, a colour proofing apparatus 10 comprises an engraved roller 12, a back pressure cylinder 14 and a conveyor 16 arranged to feed a sheet 18 of a print substrate through a nip formed between the engraved roller 12 and the back pressure cylinder 14.

An ink fountain 20 is disposed at the periphery of the engraved roller 12 for inking the surface of the engraved roller. A metered amount of ink may be filled into the ink fountain 20 with a pipette 22. The ink fountain 20 further includes a probe 24 for measuring the temperature and/or the viscosity of the ink contained therein.

Figure 2:
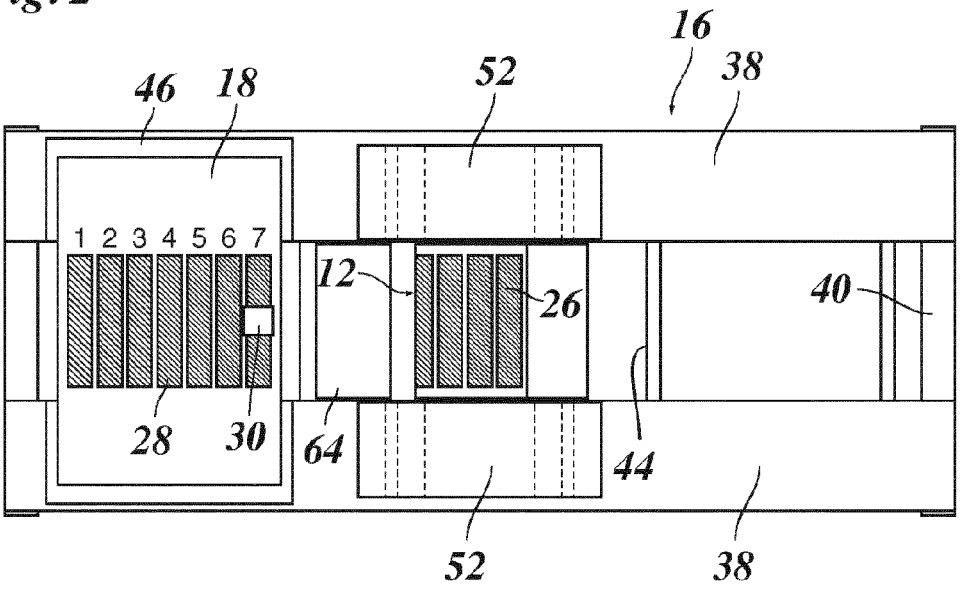
FIG. 2 shows essential parts of the apparatus shown in FIG. 1 in a top plan view.

As is generally known in the art, the surface of the engraved roller 12 is formed with a fine pattern of pits which will be filled with ink when they pass through the ink fountain 20. As is shown in FIG. 2, the peripheral surface of the engraved roller 12 carries a plurality of screens 26 each of which is formed by such a pattern of pits. The screens 26 extend in axial direction of the engraved roller in axial direction of the engraved roller and are equally distributed in circumferential direction. The volume of the pits and hence the ink carrying capacity of the screens (volume of ink per surface area) differs from screen to screen.

When the sheet 18 is fed through the nip between the engraved roller 12 and the back pressure cylinder 14, each screen 26 will print an ink layer 28 onto the print substrate, as has been shown in FIG. 2. The colours of these ink layers (numbered as 1-7 in FIG. 2) will differ from one another due to the different ink carrying capacities of the screens 26. A colour sensitive optical sensor 30, e.g. a spectrometer, is mounted in a stationary position above the conveyor 16 so as to successively measure the colour of each ink layer 28 as the sheet 18 passes through. The colours measured by the sensor 30 will be represented by colour values in a suitable colour space such as CIE XYZ or CIE L*a*b*.

As is shown in FIG. 1, the sensor 30 is combined with an illumination system 32 for illuminating the sheet on the conveyor 16. Another light source 34 is mounted below the conveying path of the sheet, so that transparent or translucent sheets may also be illuminated from below. Since the entire colour proofing apparatus 10 is accommodated in a closed casing 36 and the sensor 30 and the light sources 32, 34 are mounted in fixed positions in this casing, it is assured that the ink layers 28 on the sheets 18 will always be measured under the same illumination conditions.

The conveyor 16 has two endless conveyor belts 38 passed around guide rollers 40 and a tensioning roller 42 and spaced apart from one another in axial direction of the engraved roller 12.

A stationary part 44 of a lower cutting die (FIG. 2) is mounted in the space between the conveyor belts 38 on an upstream side of the conveyor. The lower cutting die is supplemented by two movable parts 46 each of which is fixed on or integrated in one of the conveyor belts 38. Together, the parts 44 and 46 form a rectangular cutting die for cutting out the rectangular sheet 18 from a larger blank. A corresponding upper cutting die 48 (FIG. 1) is pivotally mounted above the conveyor 16.

The cutting mechanism formed by the lower and upper cutting dies can be accessed by an operator by opening a lid 50 in the top wall of the casing 36. Thus, a blank of a print substrate may be placed on the conveyor belts 38 and the lower cutting die, and a rectangular sheet 18 may be punched out by temporarily closing the upper cutting die 48. Then, the upper cutting die is lifted again and the remaining outer portion of the blank is removed while the cut sheet 18 remains on the parts 44, 46 of the lower cutting die. The movable parts 46 of the lower cutting die are configured as sheet holders for holding the marginal areas on both sides of the sheet 18. For example, each part 46 of the lower cutting die may be formed with a suction blower and suction nozzles (not shown) for attracting the marginal areas of the sheet 18 and thereby fixing the sheet on the conveyor belts 38.

Endless guide belts 52 are disposed above the conveyor belts 38 at each end of the engraved roller 12. A lower stretch of each of these guide belts 52 extends horizontally immediately above the conveyor belt 38, so that, when the sheet 18 is fed through, the marginal areas of the sheet are safely held on the conveyor belts by the guide belts 52. This will prevent the sheet from sticking to the inked peripheral surface of the engraved roller 12.

A drive motor 54 and a drive gear (shown only schematically in FIG. 1) are provided for driving the engraved roller 12 and the guide belts 52 in synchronism. Another drive motor 56 is provided for the conveyor 16. The speeds of the drive motors 54 and 56 are synchronized electronically, so that the speed with which the sheet 18 is conveyed on the conveyor belts 38 is exactly equal to the peripheral speed of the engraved roller 12.

The back pressure cylinder 14 is also driven by the drive motor 54, and the associated drive train includes a one-way clutch 58 permitting the back pressure cylinder to rotate at a speed that is higher than the speed imposed by the drive motor 54. The axis of the back pressure cylinder 14 is supported in a set mechanism 60 that is mounted on a carriage 62 and adapted to lift and lower the back pressure cylinder 14 relative to the engraved roller 12. Although not shown in detail, the set mechanism 60 may comprise pneumatic cylinders, eccentrics and the like arranged to lift the back pressure 14 into contact with the engraved roller 12 and the sheet 18 that is passing through and to bias the back pressure cylinder against the engraved roller 12 with a pre-defined force. Since the sheet 18 has been cut to a well-defined width, this force will translate into a well-defined line pressure that will be constant irrespective of the thickness of the sheet. In addition, the back pressure cylinder 14 may have a rubber-elastic surface layer. The body of the back pressure cylinder 14 is preferably formed by a fibre-reinforced carbon, so that the back pressure cylinder 14 has a low weight and a low moment of inertia.

The carriage 62 is movable back and forth in horizontal direction in parallel with the transport direction of the sheet 18, and carries also a cleaning device 64 for the engraved roller 12. By moving the carriage 62 towards the right side in FIG. 1, the cleaning device 64 may be moved into the position of the back pressure cylinder 14 and into engagement with the lower vertex of the engraved roller 12, so that an automatic cleaning process for cleaning the engraved roller may be performed.

The top wall of the casing 36 has another lid 66 or connector giving access to the pipette 22, and yet another lid 68 gives access to the sensor 30, so that the sensor may optionally be replaced by another type of optical sensor, e.g. a colour sensor that will also be used in the flexographic printing press, so that the measurement results may directly be compared to one another.

When all the lids 50, 66 and 68 of the casing 36 are closed, the interior of the casing is sealed air-tightly. A compressor 70 or any other source of compressed air and a vent valve 72 are connected to the casing 36, so that the interior of the casing may be set under pressure and vented.

With the colour proofing apparatus 10 as described above, a colour proofing cycle may be performed as will be described below.

Figure 3:
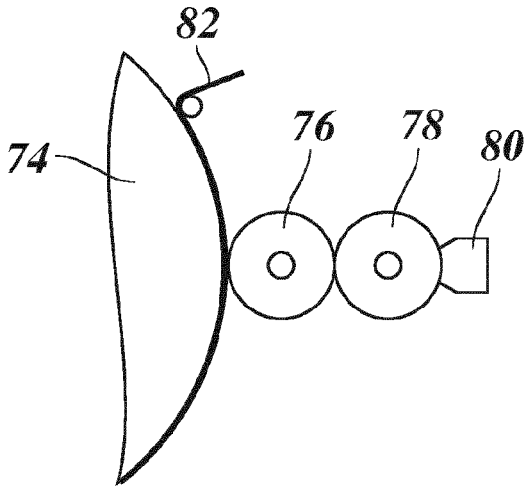
FIG. 3 is a schematic view illustrating a flexographic print process.

It shall be assumed that the proofing process aims at predicting the colour of a print product that is obtained with a flexographic printing press that has schematically been shown in FIG. 3. The printing press comprises a central impression cylinder 74 and a number of colour decks arranged at the periphery of the central impression cylinder. Only one of the colour decks has been shown in FIG. 3. This colour deck comprises a printing cylinder 76, an anilox roller 78 and a chambered doctor blade 80. A web of a print substrate 82 is passed around the central impression cylinder 74 so as to pass through the nip formed with the printing cylinder 76. The anilox roller 78 has the same surface material as the engraved roller 12 and has a pattern of minute ink-receiving pits forming a screen that is identical with or at least resembles one of the screens 26 of the engraved roller 12 in the proofing apparatus. The pits of the anilox roller 78 of the printing press are filled with ink from the chambered doctor blade 80. The anilox roller 78 is set against the peripheral surface of the printing cylinder 76 and rotated, so that the ink is transferred onto the printing cylinder 76. The printing cylinder 76 is rotated and pressed against the print substrate 82, so that the elevated printing parts of printing plates mounted on the printing cylinder 76 transfer the ink onto the print substrate 82, and an image is printed. The colour proofing apparatus 10 is used for predicting the colour of that printed image.

In order to start a proofing cycle, the vent valve 72 is opened, so that any possible elevated pressure in the casing 36 is relieved. An operator opens the lid 50 and places a blank of a web material that is identical with the material of the print substrate 82 onto the conveyor 16 and, more particularly, onto the fixed and movable parts 44, 46 of the lower cutting die. The upper cutting die 48 is pivoted onto the lower cutting die and pressed downward, so that the sheet 18 is cut out of the blank. The upper cutting die 48 is opened again, the remaining parts of the blank are removed, and the lid 50 is closed again.

Using the pipette 22, a sample of ink which has the same composition as the ink to be used in the chambered doctor blade 80 is filled into the ink fountain 20. Then, when the casing 36 is sealed air-tightly, the operator presses a start button 84 (FIG. 4) of an electronic control unit 86 that is connected to the proofing apparatus 10 and controls the further operation thereof as follows:

The vent valve 72 is closed and the compressor 70 is activated for raising the air pressure in the casing 36 to a level at which the evaporation of ink on the engraved roller 12 is reduced to an amount that corresponds to the evaporation losses of ink on the anilox roller 78 and the printing cylinder 76 of the printing press (FIG. 3) when the same operates at its normal printing speed which is much higher than the "printing" speed of the proofing apparatus 10.

The suction blowers (not shown) in the moving parts 46 of the lower cutting die are activated to suck the marginal areas of the cut sheet 18 and to hold the sheet on the movable parts 46 and hence on the conveyor belts 38. The drive motors 54 and 56 are started to drive the conveyor 16 and the guide belts 52 as well as the engraved roller 12. The conveyor belts 38 with the moving cutting die parts 46 fixed thereon move the sheet 18 towards the engraved roller 12. The back pressure cylinder 14 is still held in a lowered position in which it is not in contact with the engraved roller nor with the sheet 18. Meanwhile, the screens 26 on the engraved roller 12 take up ink from the ink fountain 20 and, as the engraved roller rotates, this ink is conveyed along the periphery of the engraved roller. Note that, in this phase, evaporation of ink is suppressed by the increased air pressure. The temperature and viscosity of the ink are measured with the probe 24 and recorded in the control unit 86.

When the leading edge of the sheet 18 has passed through between the engraved roller 12 and the back pressure cylinder 14, the set mechanism 60 is activated to lift the back pressure cylinder 14 and bias the same with the pre-defined line pressure against the web 18. The drive motor 54 drives the back pressure cylinder 14 with a circumferential speed that is slightly lower than that of the engraved roller 12. As soon as the back pressure cylinder comes into frictional contact with the sheet 18, the one-way clutch 58 permits the back pressure cylinder to accelerate until the circumferential speed is exactly identical with that of the engraved roller 12, so that no slippage will occur between the rollers and the sheet, regardless of the amount of compression of the rubber-elastic layer of the back pressure cylinder. Thanks to the low moment of inertia of the back pressure cylinder 14, this speed adjustment is achieved within a very short time.

Then, the screens 26 which have been inked in the ink fountain 20 will successively reach the nip between the engraved roller 12 and the back pressure cylinder 14, and the ink will be transferred onto the sheet 18 to form the ink layers 28 in a well reproducible manner.

Before the trailing edge of the sheet 18 reaches the nip, the back pressure cylinder 14 is lowered again and brought out of contact with the sheet and the engraved roller 12, so that the back pressure cylinder is prevented from becoming soiled with ink.

Meanwhile, the guide belts 52 force the sheet 18 to stay on the conveyor belts 38 and prevent the sheet from sticking to the peripheral surface of the engraved roller 12.

The vent valve 72 is opened so as to relieve the elevated pressure in the casing 36.

The sheet 18 reaches the position of the sensor 30 and, while the illumination system is activated, the colours of the ink layers 28 are measured and recorded as the sheet passes through below the stationary sensor 30. The measured colour values are transmitted to the control unit 86 for further processing.

Then, the transport direction of the conveyor 16 is reversed, so that the movable parts 46 of the lower cutting line, with the sheet 18 still held thereon, are returned to the position shown in FIG. 1. When the sheet has cleared the gap between the engraved roller 12 and the back pressure cylinder 14, the carriage 62 is moved rightwards in FIG. 1, so that the cleaning unit 64 is brought into its operative position, and the peripheral surface of the engraved roller 12 is cleaned. It should be noted that the conveyor belts 38 pass outside of the axial ends of the engraved roller 12 as is shown in FIG. 2, so that they will not become stained with ink.

Finally, the lid 50 may be opened and the sheet 18 may be taken out, and a new proofing cycle may begin.

If a proof has to be made for reverse side printing on a transparent print substrate, the sheet 18 with the ink layers 28 formed on the top side (which will be the reverse side in the actual print process) may be taken out and reversed manually for measuring the colours of the ink layers with the sensor 30 through the transparent sheet.

The colour values that have been measured with the sensor 30 for each of the ink layers 28 are processed in the control unit 86 and are displayed on a monitor 88, e.g. a touch screen, of the control unit.

As is commonly known in the art, the colour values are represented in a three-dimensional colour space, e.g. the L*a*b* colour space. The monitor 88 may be used for showing a three-dimensional perspective view of this colour space and/or any two-dimensional slice of that colour space, as selected by the operator. In the example shown in FIG. 4, the monitor shows a slice in the a-b-plane for a fixed value of L. The colour values that have been measured for each of the screens 1-7 are represented by coloured dots 90, and the corresponding screen numbers (1-7) are also displayed. In the example given in FIG. 4, colour values for screens that have not actually been measured and have ink carrying capacities between those of the measured screens 26 are interpolated by the control unit 86 and are represented by additional dots 92.

It will be understood that the proofing process with which the ink layers 28 have been formed is not exactly identical to the actual flexographic print process in the printing press (FIG. 3) which involves also the printing cylinder 76. However, based on empirical data and/or mathematical models, the effects of the printing cylinder 76 and other effects that occur in the printing press but could not be simulated in the proofing step, are calculated in the control unit 86, and, as has been symbolized by an arrow 94 in FIG. 4, each of the dots 90, 92 is mapped onto a corresponding dot 96 which represents the result of that calculation. Thus, each of the dots 96 shows the colour of the print product, i.e. the image formed on the print substrate 82, as predicted for the case that the screen of the anilox roller 78 corresponds to the screen (measured or interpolated) for which the dot 96 has been calculated.

Figure 4:
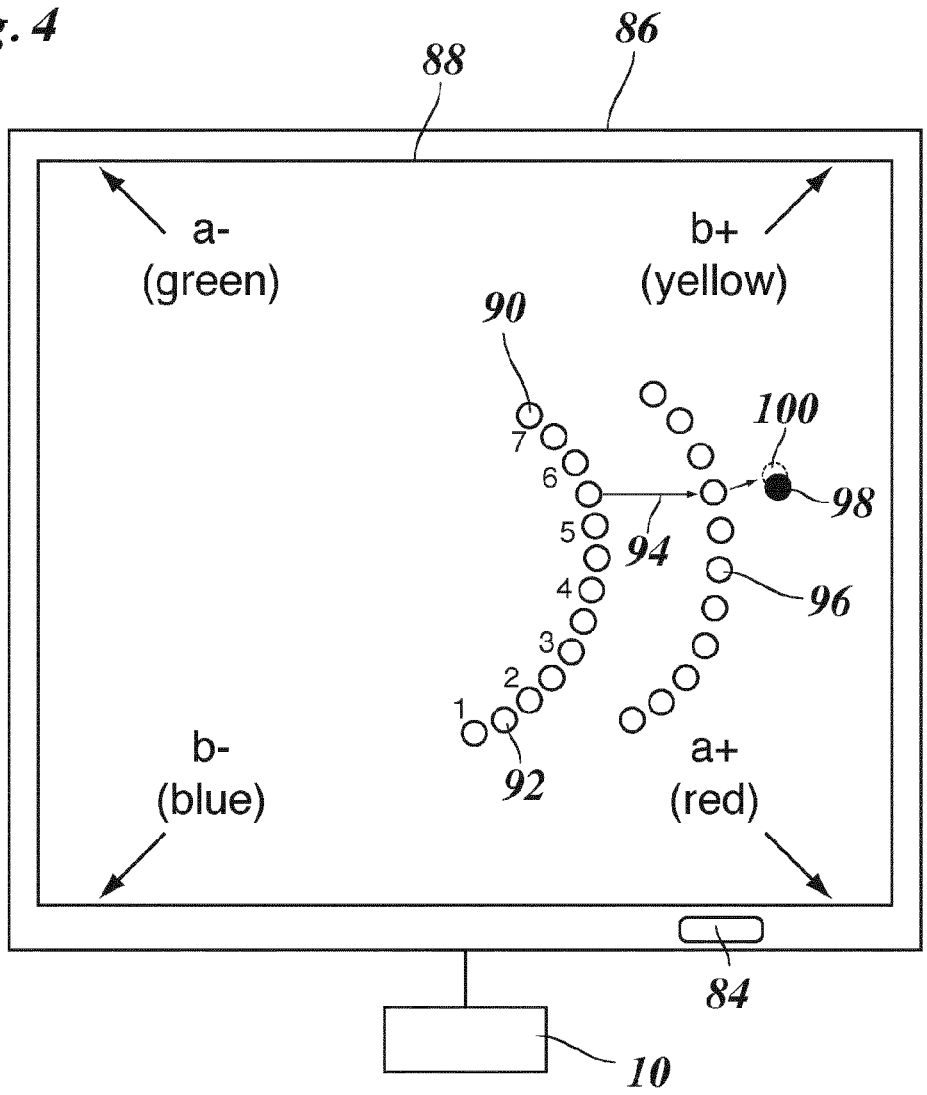
FIG. 4 shows an image to be displayed on a monitor screen of a processing unit that is connected to the colour proofing apparatus and programmed to predict colour values of a print product.

A dot 98 in FIG. 4 represents a target colour that has been specified for the image area in consideration. Thus, by comparing the sequence of dots 96 to the position of the dot 98, it is possible to select the screen (i.e. the anilox roller 78) that will be best suited for approximating the target colour (dot 98) as closely as possible.

In the example shown, none of the dots 96 coincides with the dot 98 representing the target colour. This means that, in order to come closer to the target colour, it will be necessary to change the recipe of the ink. Algorithms for calculating how the recipe must be changed in order to shift a colour value in a given direction in the colour space are known in the art and may be employed here for giving a recommendation, how the recipe should be changed (e.g. by adding pigments to the current ink). A dot 100 in FIG. 4 represents the colour value that can actually reached with the modified ink composition.

In the calculations described above, the influence of the viscosity and temperature of the ink may also be taken into account, based on the measurement results obtained with the probe 24, and corresponding target values for the ink temperature and ink viscosity in the printing press may be given, or the predicted colour values represented by the dots 96 may be corrected in view of the actual ink viscosity and/or temperature in the printing press.

What is claimed is:

1. For later use in a flexographic printing operation, a colour proofing apparatus, comprising:

an engraved printing roller having a pattern of ink accommodating cavities on a peripheral surface thereof, an inking arrangement for inking the engraved printing roller with a sample of an ink to be used for printing, the inking arrangement including an ink fountain disposed at a periphery of the engraved printing roller and configured to accommodate, in a volume that is delimited by a part of the peripheral surface of the engraved roller, an amount of ink for inking the peripheral surface of the engraved printing roller by filling the cavities with ink when the cavities pass through the ink fountain, a back pressure cylinder forming a nip with the engraved printing roller, a passing arrangement for passing a sheet of the print substrate of the type to be used for printing through the nip formed between the engraved printing roller and the back pressure cylinder, thereby to print an ink layer onto the sheet, the passing arrangement including a conveyor adapted to feed a sheet of a print substrate through said nip in synchronism with movements of the peripheral surface of the engraved printing roller and the back pressure cylinder, and a measuring apparatus for measuring a colour value of the ink layer, the measuring apparatus including an optical sensor disposed at the conveyor for measuring a colour value of the sheet that has passed through the nip, wherein the measured colour value is usable for predicting a colour of a print product obtained in a flexographic print process in which said ink is applied to an anilox roller having a screen corresponding to that of the engraved printing roller in the proofing apparatus, and the ink is then transferred onto a printing cylinder from which it is transferred onto said print substrate.

2. The colour proofing apparatus according to claim 1, wherein the engraved printing roller has on its peripheral surface a plurality of different screens formed by patterns of ink accommodating cavities with different ink-carrying capacities, the screens being arranged in bands that extend in a longitudinal direction of the engraved roller, and the optical sensor is mounted in a fixed position in the proofing apparatus.

3. The colour proofing apparatus according to claim 2, further comprising an illumination system mounted in a fixed position in the apparatus, and the optical sensor and the illumination system are shielded from external light.

4. The colour proofing apparatus according to claim 1, further comprising an air-tight casing connected to a pressure source for keeping the apparatus at an elevated air pressure.

5. The colour proofing apparatus according to claim 1, wherein the back pressure cylinder is arranged to be biased against the engraved printing roller with a predetermined force.

6. The colour proofing apparatus according to claim 1, further comprising a one-way clutch provided in a drive train for the back pressure cylinder.

7. The colour proofing apparatus according to claim 1, wherein the conveyor has two parallel conveyor belts which support opposite lateral edges of the sheet while a central part of the sheet is passed between the engraved printing roller and the back pressure cylinder.

8. The colour proofing apparatus according to claim 1, further comprising a cutting system arranged to cut the print substrate sheet with a predetermined size from a blank.

9. The colour proofing apparatus according to claim 8, wherein at least a part of cutting dies of the cutting system is fixed on conveyor belts of the conveyor and is configured as a holder for holding the sheet.

10. The colour proofing apparatus according to claim 1, further comprising a control unit configured to control the apparatus such that the back pressure cylinder is set against the engraved printing roller only after a leading edge of the sheet has passed through and the back pressure cylinder is withdrawn again from the engraved printing roller before a trailing edge of the sheet passes through.

11. The colour proofing apparatus according to claim 1, further comprising a cleaning unit mounted to be movable into a position for cleaning the surface of the engraved printing roller.

12. A method of colour proofing for later use in a flexographic printing operation, with the colour proofing apparatus according to claim 1 for proofing, the method comprising the steps of:

inking the engraved printing roller with a sample of an ink to be used for printing, passing a sheet of the print substrate of the type to be used for printing through the nip formed between the engraved printing roller and the back pressure cylinder, thereby to print an ink layer onto the sheet, measuring a colour value of the ink layer, and using the measured colour value for predicting a colour of a print product obtained in a flexographic print process in which said ink is applied to an anilox roller having a screen corresponding to that of the engraved printing roller in the proofing apparatus, and the ink is then transferred onto a printing cylinder from which it is transferred onto said print substrate.

13. The method according to claim 12, further comprising the steps of:

using a number of different engraved printing roller screens for printing a plurality of ink layers onto the sheet, and displaying colour space locations of colour values that have been measured for these ink layers on a monitor.

14. The method according to claim 13, further comprising the step of displaying colour space locations of at least one of the following on the monitor:

interpolated colour values for non-tested screens, predicted colour values, and a target colour value.

* * * * *